US006033251A

United States Patent [19]

Cook

[11] Patent Number: 6,033,251

[45] Date of Patent: Mar. 7, 2000

[54] EXTENSION CORD LOCKING DEVICE

[76] Inventor: James E. Cook, 4979 Charles Samuel Dr., Tallahassee, Fla. 32308

[21] Appl. No.: 09/084,609

[22] Filed: May 26, 1998

[51] Int. Cl.[7] ..... H01R 13/625

[52] U.S. Cl. ..... 439/369; 439/371

[58] Field of Search ..... 439/369, 367, 439/368, 370, 371

[56] References Cited

U.S. PATENT DOCUMENTS

| | | | |
|---|---|---|---|
| 4,424,407 | 1/1984 | Barbic | 174/67 |
| 4,898,542 | 2/1990 | Jones | 439/371 |
| 5,567,172 | 10/1996 | Thibault et al. | 439/371 |

*Primary Examiner*—Neil Abrams
*Assistant Examiner*—Eugene G. Byrd
*Attorney, Agent, or Firm*—John Wiley Horton

[57] ABSTRACT

A device capable of securing an extension cord to an electrical outlet, of securing two extension cords together, and of securing an extension cord to the power cord of a power tool. The device has a central portion with a hole sized to accommodate the cover plate screw found on standard electrical outlets, so that the cover plate screw may be used to secure the device to the outlet. The device also has two flexible prongs on either end which are designed to wrap around and grip an extension cord, so that one or two extension cords may be secured to the device.

7 Claims, 4 Drawing Sheets

EXTENSION CORD LOCKING DEVICE

BACKGROUND—FIELD OF INVENTION

This invention relates to electrical extension cords, and specifically to a device for securing two cords together and for securing one end of a cord to a wall outlet.

BACKGROUND—DESCRIPTION OF PRIOR ART

Extension cords are commonly used to provide electrical power to portable tools. As the portable tool gets further away from the outlet, a series of mated extension cords are typically employed. By the very nature of this use, the cords are often dragged around and placed under considerable tension, resulting in a disconnection between the last cord and the portable device, a disconnection between two of the cords, or a disconnection between the first cord and the electrical outlet.

Many proposed inventions have attempted to eliminate this recognized problem. U.S. Pat. No. 4,643,505 to House (1987) employs a split housing with movable washers to engage and hold the mated plugs of two extension cords together. Similar configurations are found in U.S. Pat. No. 5,129,839 to VanSkiver (1992) and in U.S. Pat. No. 4,169, 643 to Gallagher (1979). All three devices are relatively large, resulting in an impediment to motion when the cord is passed around corners and other obstacles in the workplace. The devices are also made from several complex pieces, requiring multiple molds for manufacturing. While they hold the cords securely, they do so by gripping the plugs, introducing a risk that the cord may be pulled free of its plug. Additionally, all three devices are difficult to remove and cumbersome if left attached to the cord.

The device shown in U.S. Pat. No. 4,221,449 to Shugart (1980) eliminates the housing, but it still has two complex molded pieces. It is also possible for the cord to slip free of the movable locking members shown. Like the '505, '839, and '643 devices, it secures the cords by gripping the plugs, again introducing the risk of pulling the cord free from its plug.

U.S. Pat. No. 4,884,979 to Budner (1989) secures the cords by gripping the cord itself, eliminating the concern discussed above. However, the Budner device employs seven separate pieces, is quite large, and would be fairly expensive to manufacture. U.S. Pat. No. 4,206,961 to Cifalde (1980) achieves the same gripping method through the use of a coiled steel wire. While simple, the Cifalde device is bulky, and liable to be snagged on obstacles as the cord is dragged around. Also, because the steel wire employed is conductive, there is a risk of electrocution if the gripping portion abrades away the cord insulation and comes in contact with the conductors.

A more compact device is shown in U.S. Pat. No. 5,179, 044 to Muromachi (1993). The Muromachi device employs a pliable rubber member in conjunction with a nylon wire tie and metal hook to fasten two plugs together. The device hold the plugs firmly and is streamlined to prevent snagging of the cord. Unfortunately, like the '505, '839, and '643 devices, it grips the plugs and not the cords. Like the Budner invention, it also uses a conductive wire for one of the grips, introducing the same electrocution hazard. Additionally, it requires three or more separate pieces, all of which have to be manipulated into position, making the device cumbersome to install and remove.

A simpler device is shown in U.S. Pat. No. 4,514,026 to Herbert (1985). The Herbert device uses a long flat member to wrap around the plugs in a crisscross fashion. One end of the device is secured to the first plug by a male pin being placed through a hole. The unsecured end is then wrapped around the second plug and secured by placing a second male pin through a second hole. The invention is simple, and is streamlined sufficiently not to snag on obstacles. However, the device once again grips the plugs and not the cord. Additionally, it requires the user to align and mate two very small pins while holding the device in the correct position. It is therefore fairly difficult to install. And, while it is effective in joining two cords together, it has no provision for securing the first cord to an electrical outlet. In fact, none of the devices reviewed incorporate any provision for securing the cord to an electrical outlet. Furthermore, the user often wishes to temporarily disconnect the cords, such as when an adjustment is made to a dangerous tool like a circular saw. The '026 and '044 devices do not allow the plugs to be disconnected without removing the securing device.

The known methods for securing extension cord connections are therefore limited in that they: (1) Grip the plugs and not the cords; (2) Are bulky and prone to snagging as the cords are dragged about; (3) Introduce a threat of electrocution; (4) Are complex; (5) Are expensive to manufacture; (6) Do not allow the plugs to be disconnected with the securing means attached; and (7) Cannot be used to secure an extension cord to an electrical outlet.

OBJECTS AND ADVANTAGES

Accordingly, several objects and advantages of the present invention are:

(1) to join two extension cords by gripping the cords and not the plugs;

(2) to join two extension cords using a compact device that will not snag as the cords are dragged around obstacles;

(3) to avoid the use of any electrically conductive material;

(4) to employ a very simple one-piece device;

(5) to ensure that the device is very cheap to manufacture;

(6) to allow the cords to be disconnected without removing the device; and (7) to provide for the attachment of an extension cord to an electrical outlet.

These objects will be fully explained in the details hereafter described, explained, and claimed, with reference being made to the accompanying drawings.

DRAWING FIGURES

REFERENCE NUMERALS IN DRAWINGS

| | |
|---|---|
| 10 | cord connector |
| 12 | center hole |
| 14 | washer |
| 16 | flexible prong |
| 18 | toggle ring |
| 20 | toggle hole |
| 22 | key way |
| 24 | plug |
| 26 | extension cord |
| 28 | electrical outlet |
| 30 | cover plate |
| 32 | cover plate screw |
| 34 | central portion |

Figure 1:
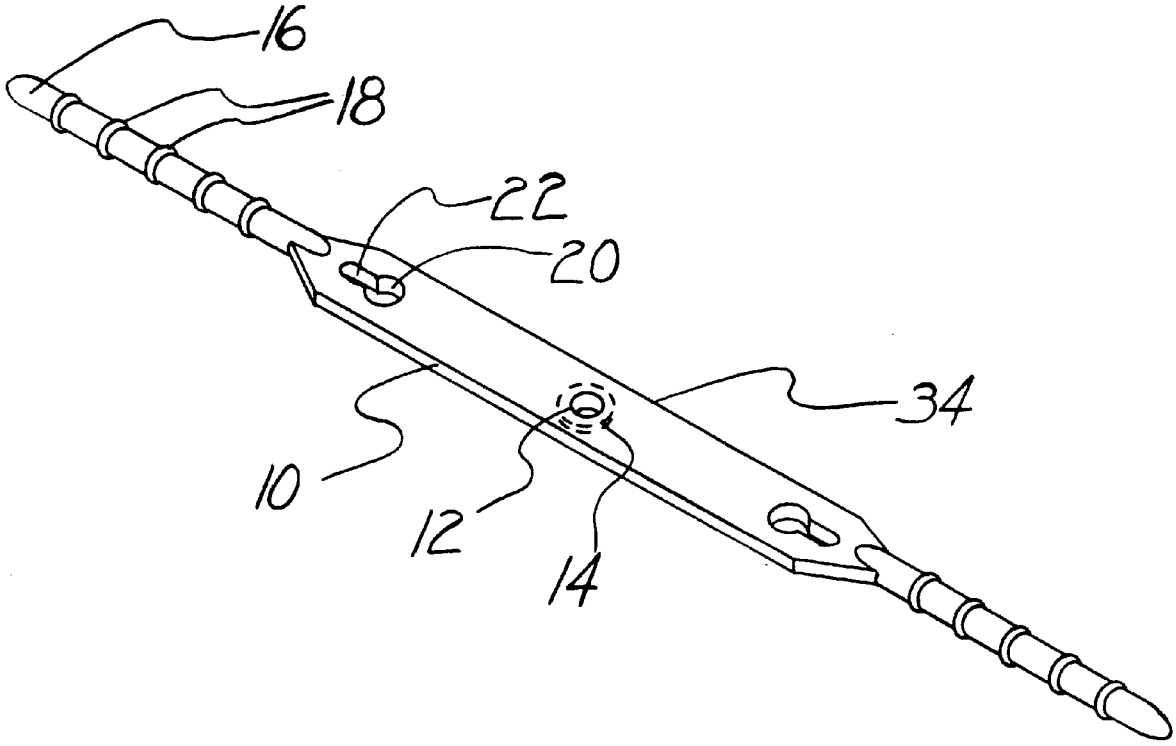
FIG. 1 is an isometric view, showing the proposed invention.

Description—FIG. 1

A typical embodiment of the present invention is illustrated in FIG. 1. Cord connector 10 is injection molded as one integral piece from suitable plastic, such as polypropylene. While the specific material selected is unimportant, it must be sufficiently flexible to allow the device to bend around an extension cord, as will be described in the "Operation" section. It is also important that the material selected be elastic, so that it tends to return to the flat state shown in FIG. 1.

Central portion 34 has center hole 12 at the middle. Washer 14 is molded integral with cord connector 10, and is completely embedded therein. The through-bore of washer 14 is aligned with center hole 12 as shown. Two flexible prongs 16 are located on either end of central portion 34. Each flexible prong 16 has a plurality of toggle rings 18 distributed evenly along its length.

Two toggle holes 20 are located in central portion 34, immediately adjacent the two flexible prongs 16. Two keyways 22 are cut into the sides of toggle holes 20 as shown.

Figure 2:
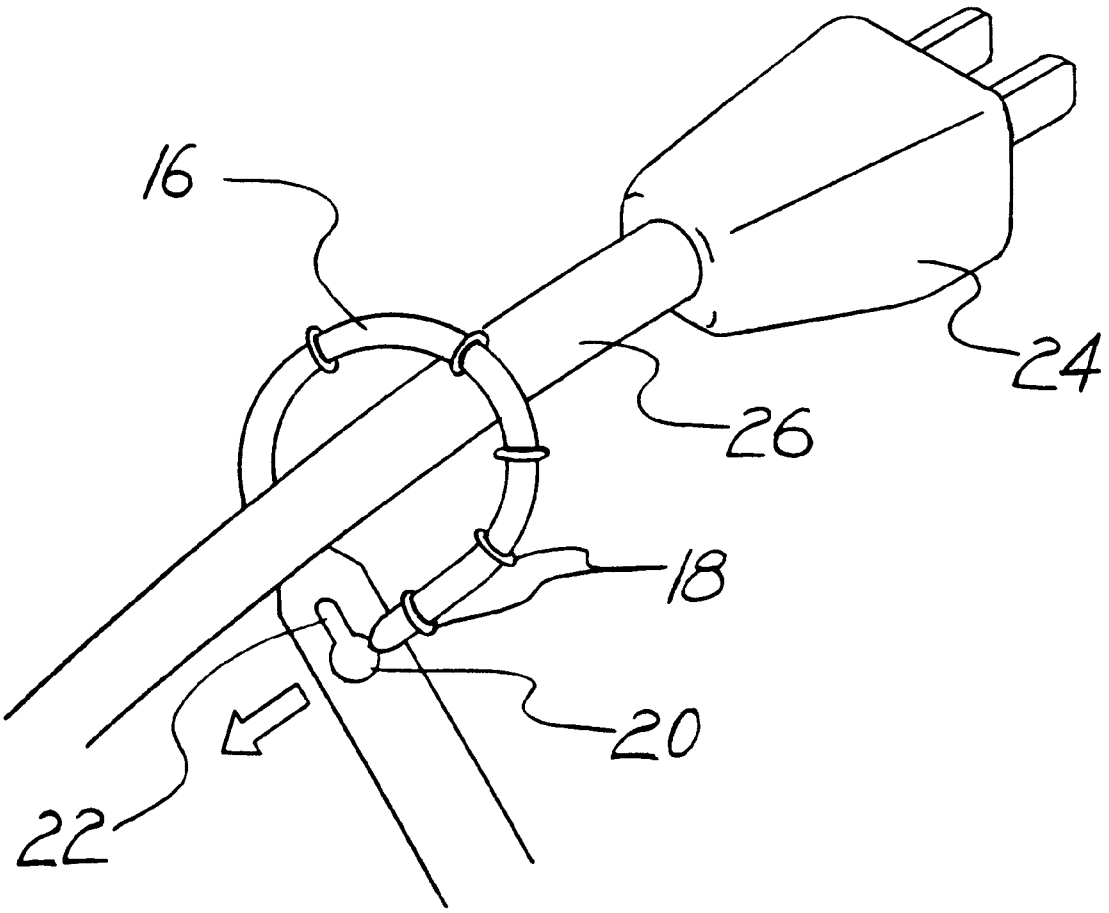
FIG. 2 is an isometric view, showing how the proposed invention attaches to an extension cord.
Figure 3:
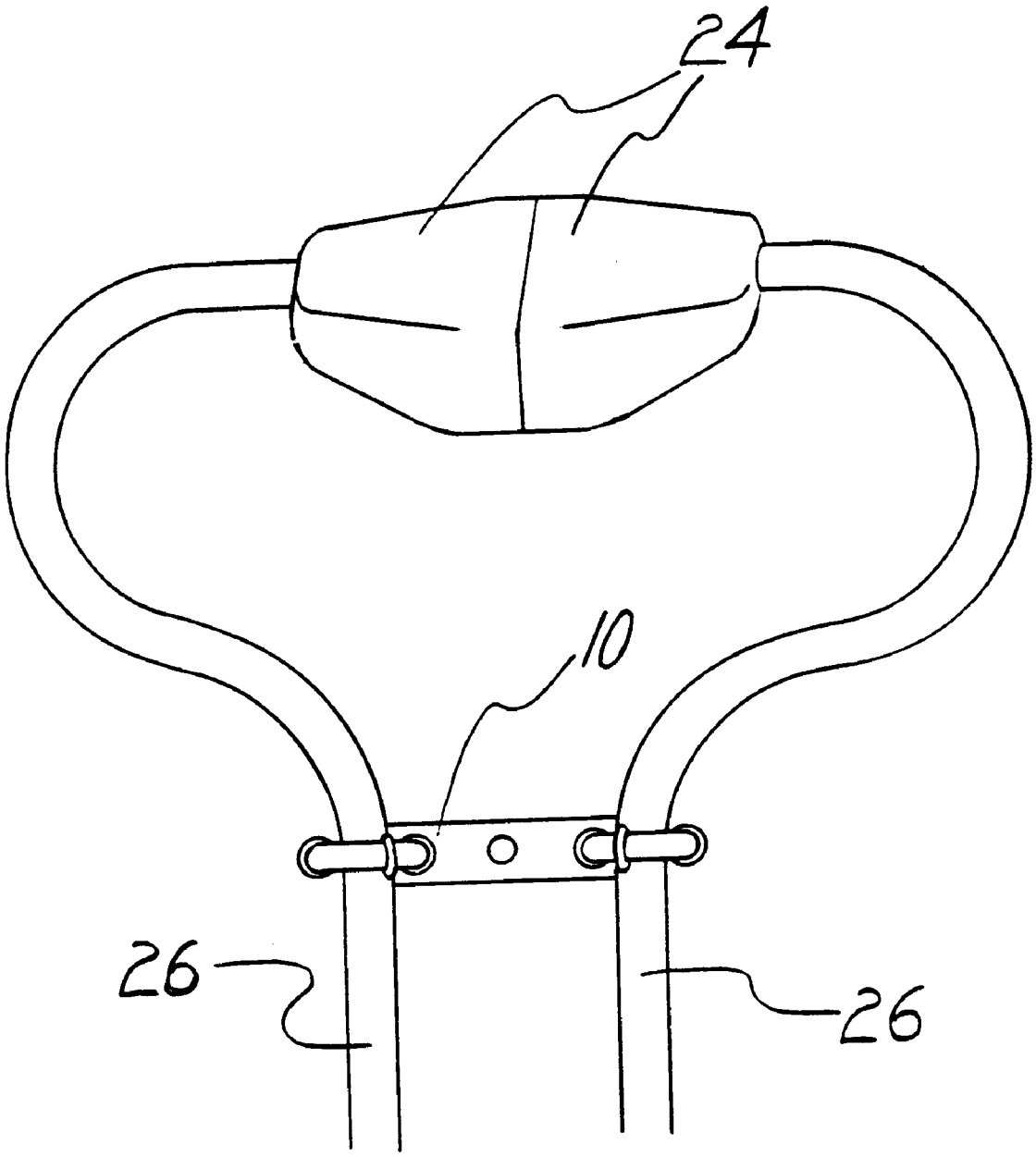
FIG. 3 is an isometric view, showing how the proposed invention joins two extension cords and prevents separation.
Figure 4:
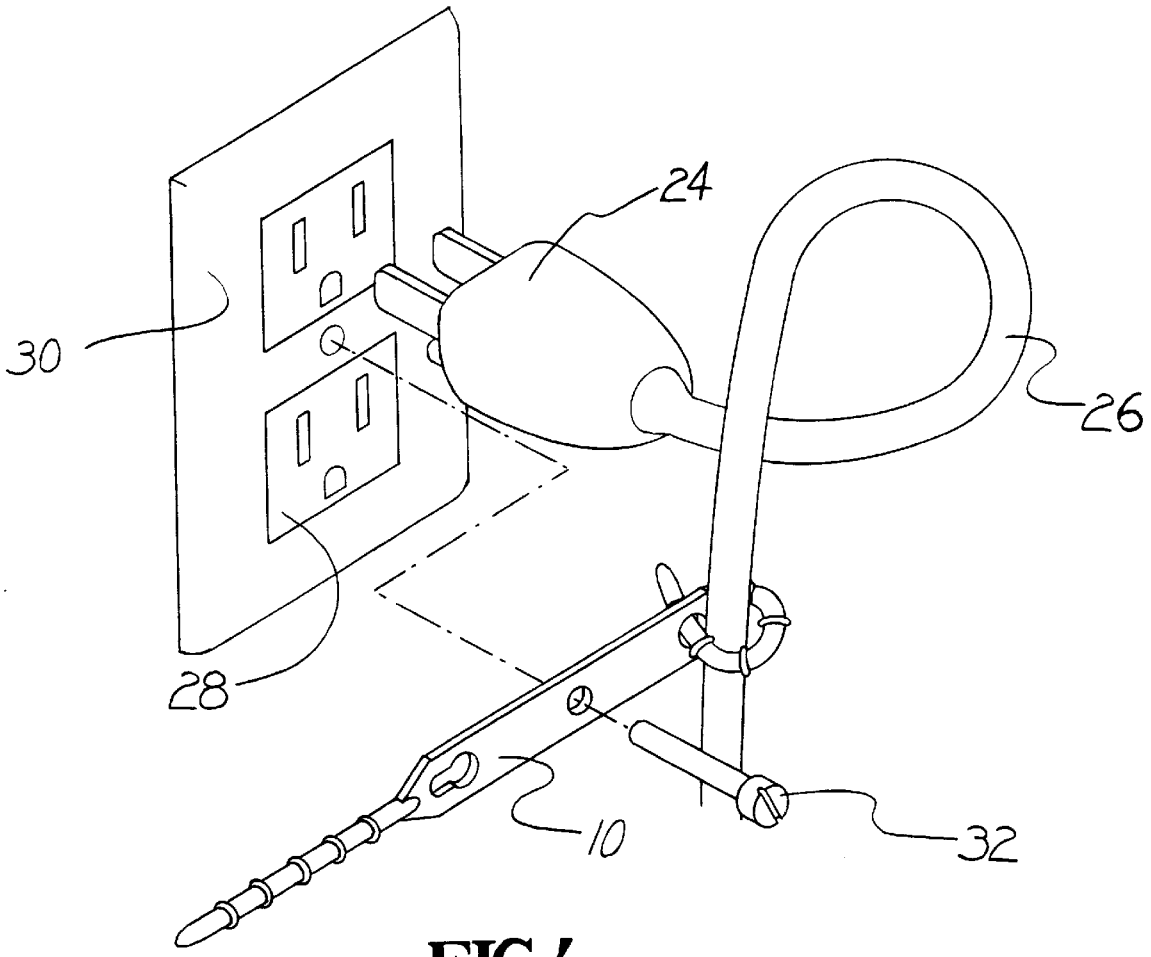
FIG. 4 is an isometric view, showing how the proposed invention attaches an extension cord to an electrical outlet.

Operation—FIGS. 2 to 4

The operation of the proposed invention will be explained with reference to FIG. 2. The user first places cord connector 10 against extension cord 26. Next, the user bends flexible prong 16 around extension cord 26. Then, the user pushes the tip of flexible prong 16 through toggle hole 20, in the direction indicated by the arrow. The user continues pushing flexible prong 16 through toggle hole 20, advancing the succession of toggle rings 18 through toggle hole 20, until flexible prong 16 is wrapped tightly around extension cord 26 and can go no further. The user then releases cord connector 10. Flexible prong 16, being molded of a resilient material, tends to straighten itself back out. As it begins to straighten, one of the toggle rings 18 will engage the edge of toggle hole 20, preventing flexible prong 16 from sliding back out of toggle hole 20. Cord connector 10 is thereby secured to extension cord 26.

If tension is placed on central section 34 of cord connector 10, it may cause toggle rings 18 to become disengaged from toggle hole 20. Keyway 22 is provided to address this concern. As tension is placed on central section 34, keyway 22 slides over flexible prong 16. Keyway 22 is just wide enough to accommodate central prong 16, but it is too narrow to allow the passage of toggle rings 18. Keyway 22 thereby securely locks flexible prong 16 in place whenever tension is placed on cord connector 10.

At this point in the operation, one end of cord connector 10 is secured to extension cord 26, and the other end is free. The user then places a second extension cord next to the free end, and repeats the previous operations in order to secure the free end of cord connector 10 to the second extension cord. Turning to FIG. 3, the two extension cords are then plugged into each other in the conventional fashion. Cord connector 10 is at this point is secured to both extension cords, as shown. As tension is placed on the two mated extension cords, cord connector 10 acts as a strain relief, transmitting the tension from one cord to the other, without transmitting any tension through the plugs themselves. Tension may thereby be transmitted from one cord to the next without the two plugs disengaging.

However, as cord tension is transmitted from cord to cord, the tension must ultimately be transmitted to the connection between the first plug and the wall socket. It therefore does very little good to prevent the chain of extension cords from disconnecting, if the entire chain is easily disconnected from the wall. Accordingly, the proposed invention also contains features intended to secure the first extension cord to the wall outlet. These features will be explained with reference to FIG. 4.

Electrical outlet 28 is a conventional two plug type. It is covered by cover plate 30, which is held in place by cover plate screw 32. While electrical outlet 28 is shown as a two-plug type, it could be a four plug type, an outdoor type, etc. All these types of plugs have a standard cover plate screw 32, and the proposed invention would operate in the same fashion.

To begin with, the user secures cord connector 10 to extension cord 26 using the same procedure as described previously. Next, the user takes a screwdriver and removes cover plate screw 32. The user then places cover plate screw 32 through center hole 12 in cord connector 10. Cover plate screw 32 is next threaded back into electrical outlet 28 and used to pull central portion 34 of cord connector 10 up against cover plate 30. The user then plugs plug 24 into electrical outlet 28. As tension is placed on extension cord 26, the tension is transmitted from the cord, through cord connector 10, and directly to electrical outlet 28. Since extension cord 26 is mechanically secured, the tension will not disengage plug 24.

The tension transmitted by this method has a tendency to stretch and distort center hole 12. Washer 14 is provided to more evenly distribute the load through central portion 34. As explained previously, washer 14 is molded within the resilient material of cord connector 10, having its central through-bore aligned with center hole 12.

The reader, upon reviewing FIG. 4, will appreciate that the second flexible prong 16 of cord connector 10 remains free for attachment to a second extension cord. Cord connector 10 is designed to secure two extension cords to electrical outlet 28. For purposes of clear illustration, the device is shown attached to only one cord.

Summary, Ramifications, and Scope

The proposed invention therefore has significant advantages over the prior art in that it: (1) joins two extension cords by grabbing the cords and not the plugs: (2) will not snag as the cords are dragged around obstacles; (3) avoids the use of any electrically conductive material in the gripping portions; (4) employs a very simple one-piece device; (5) ensures that the device is very cheap to manufacture; and (6) secures the first plug of an extension cord to an electrical outlet.

The reader will appreciate that many changes could be made to the device described without altering the fundamental nature of the invention. For example, the reinforcing washer could be omitted, the shape of the toggle rings could be altered, a different material could be used, etc. Accordingly, the scope of patent protection should be governed by the following claims, with consideration being given to the preceding detailed descriptions as well.

Having described my invention, I claim:

1. A device for securing an extension cord to an electrical outlet using the standard cover plate screw used to attach the cover plate to said outlet, comprising:

a. an elongated member having a central portion and an end portion, wherein said central portion opens into a hole passing completely through said central portion, with said hole being sized to accommodate said standard cover plate screw for purposes of securing said elongated member to said electrical outlet, with said central portion being sufficiently thin to allow its attachment using said standard cover plate screw, and b. means for securing said end portion of said elongated member to an extension cord.

2. A device as in claim 1, wherein said means for securing said elongated member to an extension cord comprises:

a. said end portion is formed in the shape of a flexible prong having a plurality of toggle rings distributed along its length, and b. said central portion opens into a second hole passing completely through said central portion, with said second hole being located proximate the point of transition between said central portion and said end portion, and said second hole being sized to allow the passage of said toggle rings on said flexible prong, so that said flexible prong may be bent around an extension cord and thrust through said second hole.

3. A device as in claim 1, wherein said elongated member has a second end portion, said second end portion having means for attaching said second end portion to a second extension cord.

4. A device as in claim 3, wherein said means for securing said elongated member to said second extension cord comprises:

a. said second end portion is formed in the shape of a second flexible prong having a plurality of toggle rings distributed along its length, and b. said central portion opens into a third hole passing completely through said central portion, with said third hole being located proximate the point of transition between said central portion and said second end portion, and said third hole being sized to allow the passage of said toggle rings on said second flexible prong, so that said second flexible prong may be bent around an extension cord and thrust through said third hole.

5. A device for securing two extension cords together comprising:

a. an elongated member having a central portion, a first end portion, and a second end portion, wherein said central portion opens into a hole passing completely through said central portion, with said hole being sized to accommodate a cover plate screw for purposes of securing said elongated member to an electrical outlet;

b. means for securing said first end portion of said elongated member to a first extension cord; and c. means for securing said second end portion of said elongated member to a second extension cord.

6. A device as in claim 5, wherein said means for securing said first end portion to said first extension cord comprises:

a. said first end portion is formed in the shape of a first flexible prong having a plurality of toggle rings distributed along its length, and b. said central portion opens into a second hole passing completely through said central portion, with said second hole being located proximate the point of transition between said central portion and said first end portion, with said second hole being sized to allow the passage of said toggle rings on said first flexible prong, so that said first flexible prong may be bent around said first extension cord and thrust through said second hole.

7. A device as in claim 5, wherein said means for securing said second end portion to said second extension cord comprises:

a. said second end portion is formed in the shape of a second flexible prong having a plurality of toggle rings distributed along its length, and b. said central portion opens into a third hole passing completely through said central portion, with said third hole being located proximate the point of transition between said central portion and said second end portion, with said third hole being sized to allow the passage of said toggle rings on said second flexible prong, so that said second flexible prong may be bent around said second extension cord and thrust through said third hole.

* * * * *